US007252599B2

(12) United States Patent
Hasegawa

(10) Patent No.: US 7,252,599 B2
(45) Date of Patent: Aug. 7, 2007

(54) GOLF CLUB HEAD

(75) Inventor: Hiroshi Hasegawa, Kobe (JP)

(73) Assignee: SRI Sports Limited, Kobe-shi, Hyogo-ken (JP)

( * ) Notice: Subject to any disclaimer, the term of this patent is extended or adjusted under 35 U.S.C. 154(b) by 320 days.

(21) Appl. No.: 11/050,741

(22) Filed: Feb. 7, 2005

(65) Prior Publication Data

US 2005/0215351 A1 Sep. 29, 2005

(30) Foreign Application Priority Data

Mar. 24, 2004 (JP) ..... 2004-087560

(51) Int. Cl.
*A63B 53/04* (2006.01)

(52) U.S. Cl. ..... 473/329; 473/345; 473/347; 473/349

(58) Field of Classification Search ..... 473/324–350
See application file for complete search history.

(56) References Cited

U.S. PATENT DOCUMENTS 4,021,047 A * 5/1977 Mader ..... 473/345
5,328,176 A * 7/1994 Lo ..... 473/342
5,425,538 A * 6/1995 Vincent et al. ..... 473/342
5,624,331 A * 4/1997 Lo et al. ..... 473/345
5,704,850 A * 1/1998 Shieh ..... 473/324
6,623,378 B2 * 9/2003 Beach et al. ..... 473/345
6,648,774 B1 * 11/2003 Lee ..... 473/342
6,849,003 B2 * 2/2005 Kumamoto ..... 473/305
6,875,126 B2 * 4/2005 Yabu ..... 473/305
6,929,565 B2 * 8/2005 Nakahara et al. ..... 473/345
6,945,876 B2 * 9/2005 Nakahara et al. ..... 473/329
7,094,159 B2 * 8/2006 Takeda ..... 473/345
2005/0020379 A1 * 1/2005 Kumamoto ..... 473/332
2005/0026723 A1 * 2/2005 Kumamoto ..... 473/345
2005/0209024 A1 * 9/2005 Oyama ..... 473/347

FOREIGN PATENT DOCUMENTS

JP 2003-205055 A 7/2003

* cited by examiner

*Primary Examiner*—Sebastiano Passaniti
(74) *Attorney, Agent, or Firm*—Birch, Stewart, Kolasch & Birch, LLP

(57) ABSTRACT

A hollow golf club head is formed form a metal member with at least one opening. An FRP member made of a fiber reinforced resin is attached to the metal member to cover the opening. The metal member has at least one slit extending along at least a periphery of the opening and further includes an outer surface and an inner surface. The FRP member has a locking portion that enters into the slit from one side of the outer surface or the inner surface of the metal member and exiting from the other side so as to extend along a surface thereof.

11 Claims, 18 Drawing Sheets

GOLF CLUB HEAD

BACKGROUND OF THE INVENTION

1. Field of the Invention

The present invention relates to a golf club head, more particularly to a joint structure of a metal part made of a metal material and a FRP part made of a fiber reinforced resin.

2. Description of the Related Art

In recent years, golf club heads made of a metal material and fiber reinforced resin have been proposed. These heads can save the weight thereof on the basis of the small specific gravity of the resin. Further, the saved weight can be allocated, for example, in the sole portion or the like, and can improve degree of freedom in the weight allocation design or the like.

However, in the head mentioned above, an adhesive strength tends to be short in a joint portion between the metal material and the resin. Accordingly, there has been conventionally proposed various techniques of improving a rigidity of the joint portion.

For example, in Japanese Unexamined Patent Publication No. 2003-205055, as shown in FIGS. 15(A) and 15(B), there is described a head "a" comprising a metal member b provided with an opening "o" in a crown portion and made of a metal material, and a FRP member "c" arranged in the opening and made of a fiber reinforced resin. The FRP member c includes edge pieces c1 and c2 bonded to an inner side and an outer side of an edge portion j of the metal member b. However, in this structure, a crack tends to be generated from a portion between the edge pieces c1 and c2 of the bifurcated inner and outer FRP members, due to a great impact force at a time of striking a ball.

Further, in the document mentioned above, as shown in FIGS. 16(A) and 16(B), there has been proposed a structure in which a plurality of through holes f are intermittently provided in the edge portion j of the metal member b, and a cord g joining the edge pieces c1 and c2 of the inner and outer FRP members and made of a fiber reinforced resin is arranged in the through holes f. However, a shear force due to the impact force at a time of striking the ball tends to act on a joint interface between the edge pieces c1 and c2 and the cord body f. Accordingly, it is desired to further improve the adhesive strength.

SUMMARY OF THE INVENTION

It is therefore, an object of the present invention to provide a golf club head, in which the joint portion is increased in the strength, and thereby the durability of the club head is improved.

In accordance with the present invention, a hollow golf club head comprises a metal member made of at least one kind of metal material having at least one opening, and a FRP member made of a fiber reinforced resin attached to the metal member so as to cover the opening, wherein the metal member has at least one slit extending along the opening, in at least a part of a periphery of the opening, and the FRP member has a locking portion entering into the slit from one side of an outer surface or an inner surface of the metal member and getting out of the other side so as to extend along a surface thereof.

DESCRIPTION OF THE PREFERRED EMBODIMENTS

Embodiments of the present invention will now be described in detail in conjunction with the accompanying drawings.

Figure 1:
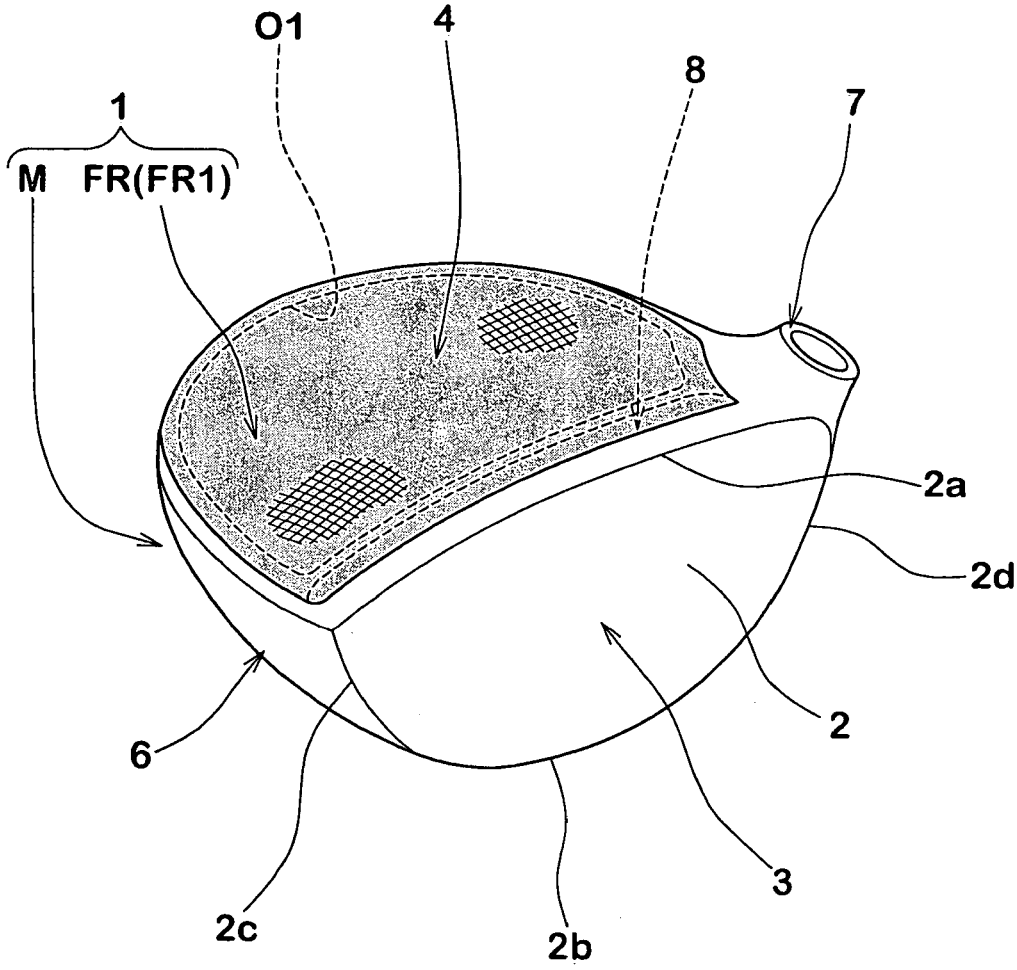
FIG. 1 is a perspective view of a wood-type gold club head according to the present invention.
Figure 2:
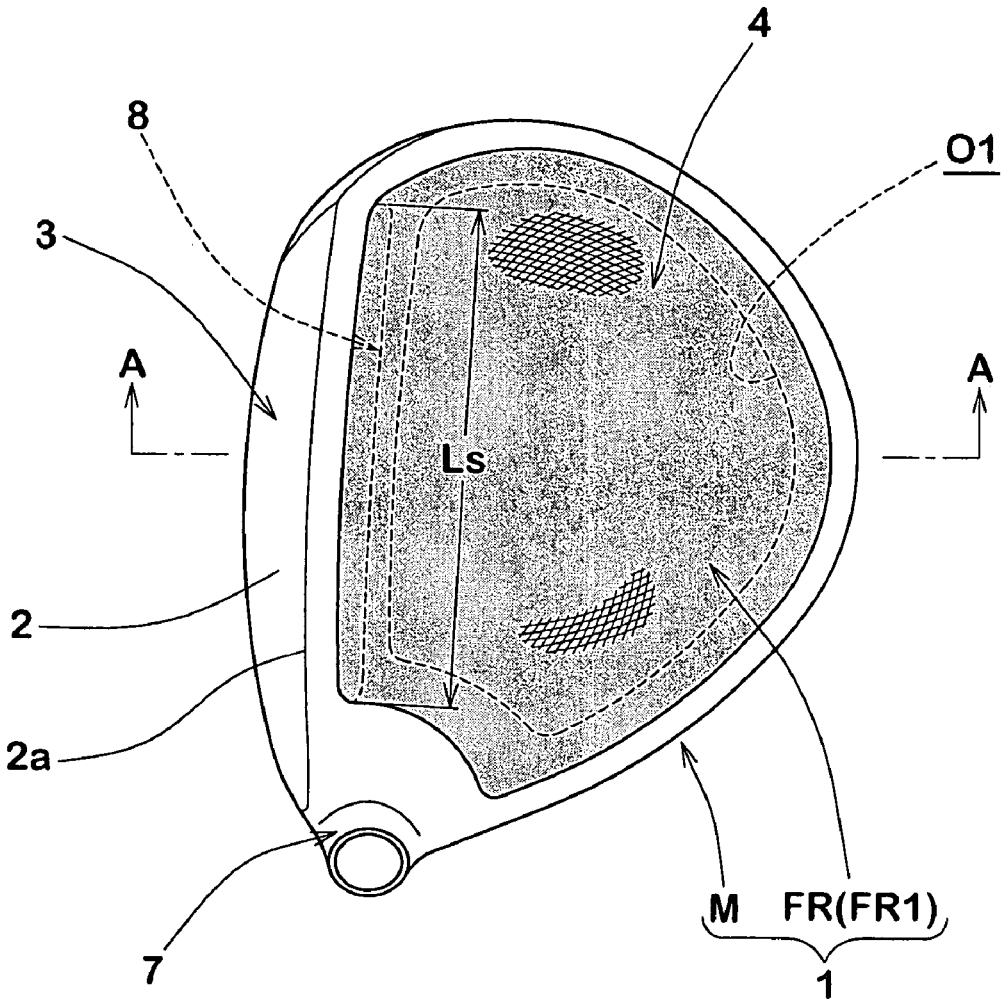
FIG. 2 is a plan view thereof.
Figure 3:
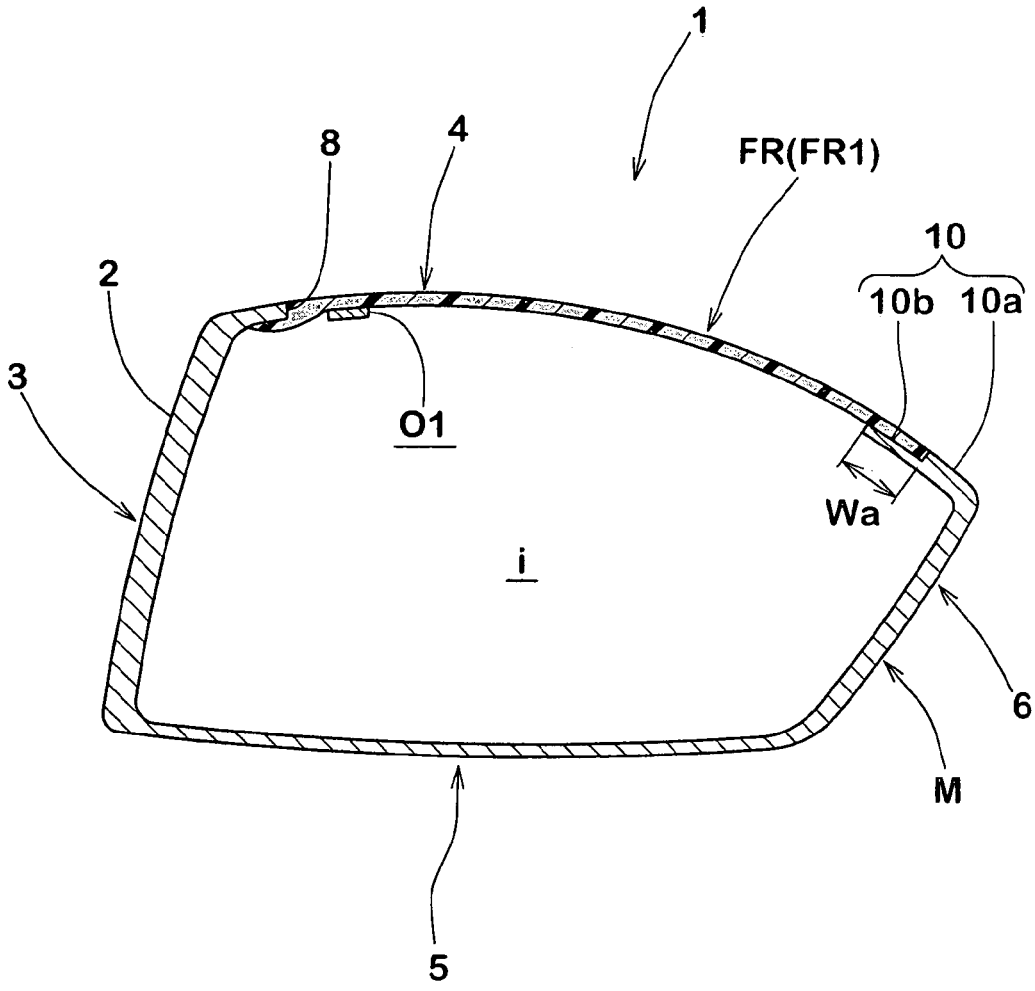
FIG. 3 is a cross sectional view taken on line A-A in FIG. 2.

FIGS. 1 to 3 show a standard condition in which a golf club head 1 according to the present embodiment is grounded on a horizontal surface (not shown) at a prescribed lie angle and loft angle. In the drawings, the club head 1 according to the present invention is a wood-type club head such as #1 driver and fairway wood. The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and the sole portion 5 which extends from a toe-side edge 2*c* to a heel-side edge 2*d* of the club face 2 through the back face of the club head; and a neck portion 7 to be attached to an end of a club shaft (not shown).

The head 1 comprises a metal member M, and a FRP member FR attached to the metal member M.

The FRP member FR according to the present embodiment is exemplified by a crown side FRP member FR1 structuring at least a part of the crown portion 4. The FRP member FR1 is a composite material composed of a matrix resin and a reinforcing fiber. The composite material has a smaller specific gravity in comparison with the metal material. Accordingly, the head 1 according to the present embodiment can obtain a comparatively great weight saving effect in the crown portion 4 by employing the crown side FRP member FR1. The saved weight is consumed for enlarging a size of the metal member M or is allocated to a proper portion of the metal member M, for example. Accordingly, it serves for improving a freedom of designing a weight allocation of the head 1. Further, in the case that the FRP member FR is provided in the crown portion as in the present embodiment, a gravity point of the head becomes lower.

The matrix resin mentioned above is not particularly limited, however, there can be listed up, for example, a thermosetting resin such as an epoxy resin, a phenol resin and an unsaturated polyester resin; and a thermoplastic resin such as a polycarbonate resin and a nylon resin. The former matrix resin is preferable in a point that it is inexpensive, has an improved adhesive property with the fiber and has a comparatively short forming time. Further, the fiber is not particularly limited, however, can employ a carbon fiber; a glass fiber; an organic fiber such as an aramid fiber, a polyphenylene benzoxazole resin fiber (PBO fiber) or the like; and a metal fiber such as an amorphous fiber, a titanium fiber or the like. Especially, the carbon fiber having a small specific gravity and a large tensile strength is preferable.

Further, an elastic modulus of the fiber is not particularly limited, however, if it is too small, it is impossible to secure a rigidity of the FRP member FR and a durability tends to be lowered, and if it is inversely too large, a cost thereof is increased, and the tensile strength tends to be lowered. From this point of view, it is desired that the elastic modulus of the fiber is not less than 50 GPa, more preferably not less than 100 GPa, and further preferably not less than 200 GPa. Further, it is desirable that an upper limit is preferably not more than 400 GPa, more preferably not more than 350 GPa, and further preferably not more than 300 GPa. In this case, the elastic modulus of the fiber corresponds to an elastic modulus in tension, and is constituted by a value measured according to "carbon fiber test method" in JIS R7601. Further, in the case that two or more kinds of fibers are contained, there is employed an average elastic modulus obtained by calculating the elastic modulus of each of the fibers by weighing on the basis of a weight ratio, as shown by the following expression.

Average elastic modulus $$=\Sigma(Ei\cdot Vi)/\Sigma Vi(i=1, 2, \ldots)$$

(wherein "Ei" denotes an elastic modulus of a fiber i, and "Vi" denotes a total weight of the fiber i).

Figure 4:
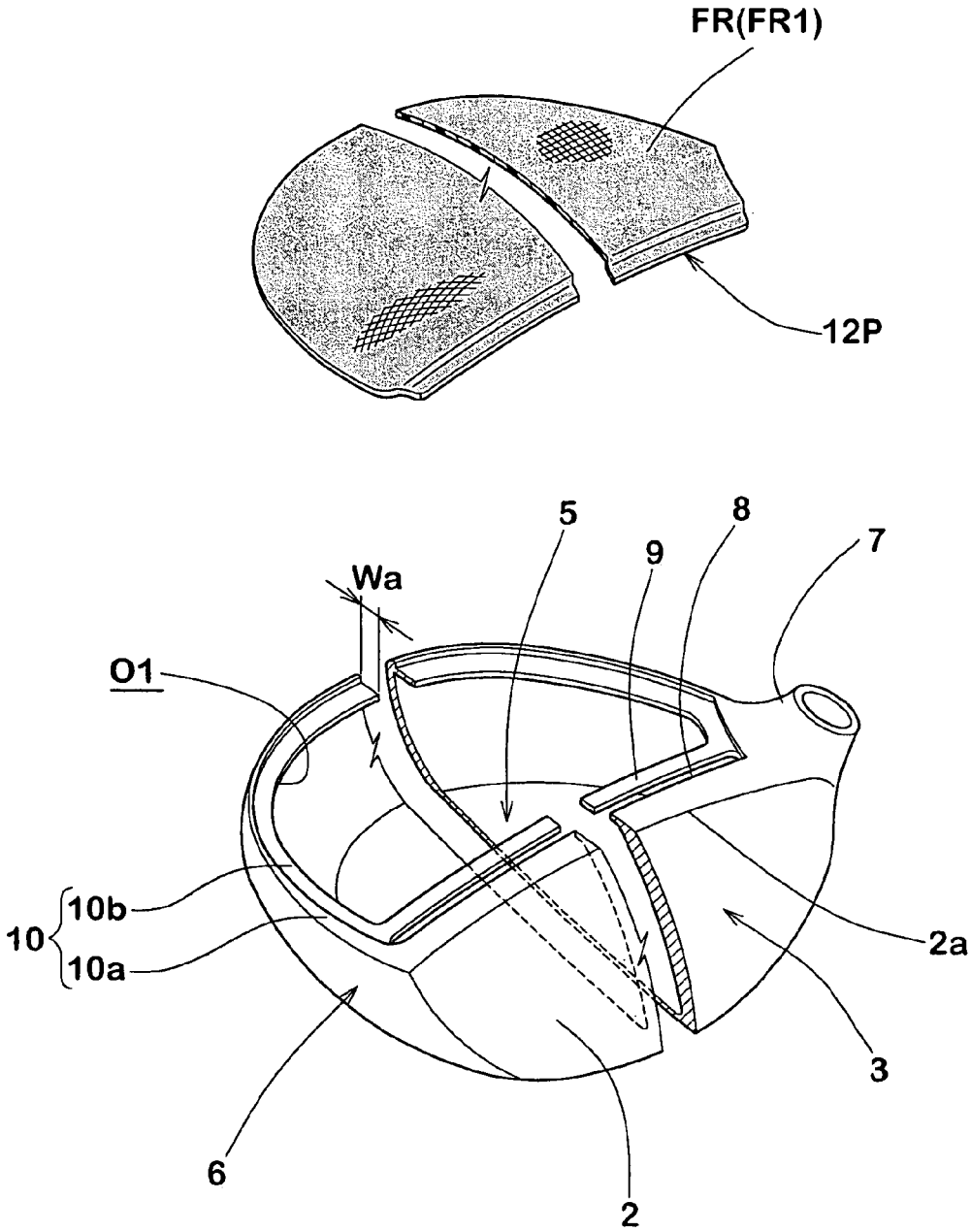
FIG. 4 is an exploded perspective view showing a metal member and a FRP member.

The metal member M according to the present embodiment comprises, as shown in FIG. 4, the face portion 3, the sole portion 5, the side portion 6, the neck portion 7 and a crown edge portion 10 formed around an opening O1 in the crown portion 4. The metal member M according to this embodiment is integrally formed in each of the portions by casting. Further, according to another embodiment, the metal member M is formed by forming two or more parts according to a working method such as forging, casting, pressing or rolling and thereafter integrally bonding them according to welding or the like.

The metal material forming the metal member M is not particularly limited, however, can employ, for example, a stainless steel, a maraging steel, a titanium, a titanium alloy, an aluminum alloy, a magnesium alloy, an amorphous alloy or the like. Especially, a titanium alloy, an aluminum alloy or a magnesium alloy, having a large specific strength, is desirable. In this case, the metal member M can be formed by using two or more kinds of metal materials.

As shown in FIGS. 3 and 4, the crown edge portion 10 includes a crown surface portion 10*a* forming an outer surface of the crown portion 4 and annularly extending around the opening O1, and a receiving portion 10*b* having a step from the crown surface portion 10*a* in a surface and depressed to a side of the hollow portion i. The receiving portion 10*b* can hold an inner surface side of the crown side FRP member FR1 and a peripheral edge portion thereof. Further, the receiving portion 10*b* serves for finishing the crown surface portion 10*a* and the FRP member FR1 flush.

The receiving portion 10*b* and the crown side FRP member FR1 are bonded therebetween. The receiving portion 10*b* according to the present embodiment is continuously and annularly provided in an entire periphery around the opening o1, however, may be partly interrupted. It is desirable that the receiving portion 10*b* is formed at a length not less than 50% of an opening length L of the opening O1 along an opening edge, more preferably not less than 60%, and further preferably not less than 70%. The receiving portion 10*b* increases a bonding area between the crown side FRP member FR1 and the metal member M, and serves for obtaining a larger adhesive strength.

Further, a width Wa of the receiving portion 10*b* measured in a perpendicular direction from an edge of the opening O1 is not particularly limited, however, if it is too small, the bonding area between the metal member M and the crown side FRP member FR1 becomes small, whereby a bonding strength tends to be lowered, and if it is inversely too large, the area of the opening O1 becomes small, whereby there is a tendency that the weight saving effect can not be sufficiently obtained. From this point of view, it is desirable that the width Wa is, for example, not less than 3 mm, and more preferably not less than 6 mm, and it is desirable that the upper limit is not more than 25 mm, and more preferably not more than 15 mm. In this case, the width Wa of the receiving portion 10*b* may be fixed, or may be changed.

The metal member M is provided with at least one slit 8 extending along the opening O1 and passing through the hollow portion i, in at least a part of the periphery of the opening O1. In the present embodiment, the slit 8 is provided in the receiving portion 10*b* provided in the crown portion 4. In specific, one slit 8 is provided in the receiving portion 10*b* between the opening O1 and the upper edge 2*a* of the club face 2. The slit 8 extends in a direction of toe and heel along the upper edge 2*a* of the club face 2. A locking portion 12P of the crown side FRP member FR1 enters into the slit 8. This matter will be described later in detail.

The crown side FRP member FR1 is attached to the metal member M so as to cover the opening O1 and forms a part of the crown portion 4, in the present embodiment. It is not necessary that the crown side FRP member FR1 forms an entire of the crown portion 4, but it is sufficient that it forms at least a part thereof. However, if the area of the FRP member FR1 (in other words, the opening O1) is too small, there is a tendency that a sufficient weight saving effect can not be obtained in the head 1. Accordingly, in a plan view in the standard state shown in FIG. 2, it is desirable that a ratio (S1/S) between an area S1 of the opening O1 provided in the crown portion 4 and an area S surrounded by a head profile line is preferably not less than 0.5, and more preferably not less than 0.6, and it is desirable that an upper limit thereof is, for example, not more than 0.9, and preferably not more than 0.8.

The crown side FRP member FR1 according to the present embodiment is constituted by a molded product integrally formed in the metal member M according to an internal pressure molding method. The internal pressure molding method is executed so as to include the following steps in the present embodiment.

Figure 5:
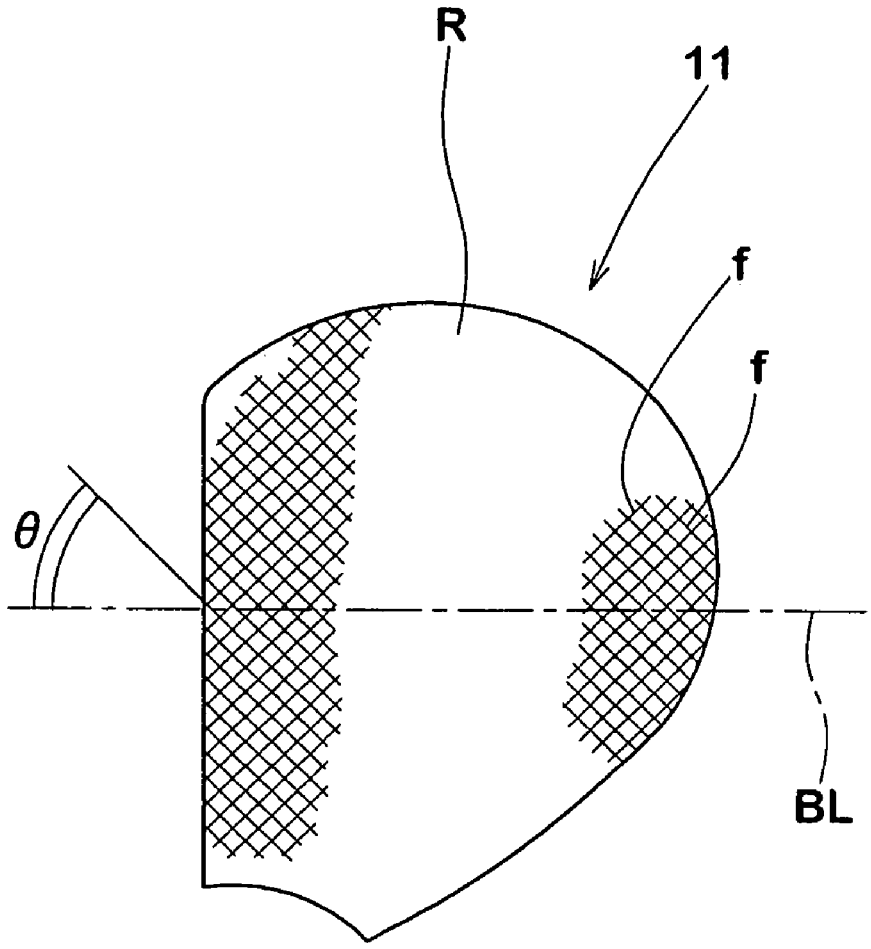
FIG. 5 is a plan view of a prepreg.
Figure 6:
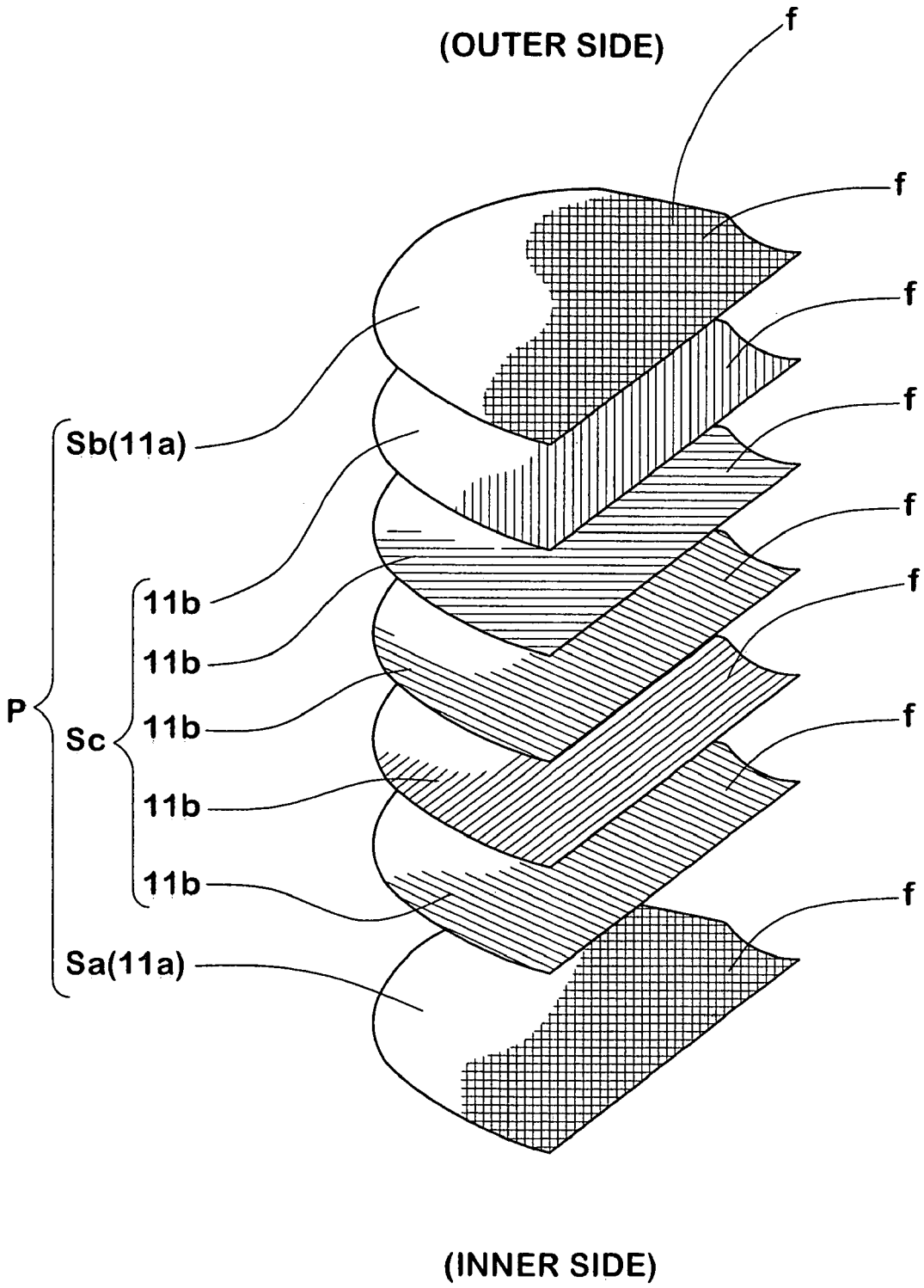
FIG. 6 is an exploded perspective view showing a plurality of plies of prepreg.

First, a plurality of prepreg plies having a magnitude capable of covering the opening O1 are prepared. The number of the prepreg plies can be appropriately selected, and can be set to two to about thirty, for example. In FIG. 5, one example of the prepreg ply 11 is shown by a plan view. The prepreg ply 11 is a sheet body in a semi hard state comprising a resin R and reinforcing fibers f dipped therein. The fibers f are aligned with in one direction or woven in an intersecting direction (the latter structure is shown in this example). Further, the prepreg ply is appropriately preformed in a necessary shape previously as shown in FIG. 5. As shown in FIG. 6, a plurality of prepreg plies 11 are, for example, previously laminated so as to be prepared as a laminated body P. The laminated body P may be laminated by utilizing a viscosity of the surface of the prepreg itself, or can be prepared in a state in which the laminated body is not easily peeled off, by interposing an uncured resin primer or the like. In this case, the prepreg plies 11 may be used one by one in an auxiliary assembling step mentioned below without being laminated.

Further, in the laminated body P, it is desirable that a so-called cloth prepreg ply 11*a* woven so that the fibers intersect (intersect at 90 degrees in this example) is used in at least one of an innermost layer Sa and an outermost layer Sb, more preferably both thereof. The cloth prepreg ply 11*a* has a small deviation at a time of cure and can easily obtain a uniform elongation. Accordingly, it is possible to lower a molding defect of the FRP member FR by using the cloth prepreg ply 11*a* in the innermost layer Sa and the outermost layer Sb of the laminated body P in which the elongation becomes comparatively large. Further, an intermediate layer Sc between the innermost layer Sa and the outermost layer Sb in the laminated body P comprises a plurality of so-called unidirectional prepreg (UD prepreg) plies 11*b* in which the fibers f are aligned in unidirection, in the present example. The unidirectional prepreg ply 11*b* mentioned above serves for lowering a cost and can increase rigidity along the fiber therein. In this embodiment, carbon fibers having the same elastic modulus are employed for each of the prepreg plies 11*a* and 11*b*, and the same epoxy resin is employed for the matrix resin. In this case, it goes without saying that it is possible to appropriately change.

Further, in the laminated body P, as shown in FIG. 6, it is desirable to differentiate a fiber orientation θ of a plurality of prepreg plies 11 with respect to a base direction BL which is expected as a normal direction of the club face 2. In the present embodiment, the cloth prepreg plies 11*a* are used in the innermost layer Sa and the outermost layer Sb by being inclined such that the fiber orientation θ becomes ±45 degrees. Further, in the intermediate layer Sc, the angle θ of the fiber orientations are set to be substantially 0°, 90°, 0°, +45° and −45° from an inner side, whereby the fibers f are overlapped in an intersecting direction to each other. The angle θ of the fiber orientation can be appropriately set in correspondence to an elastic modulus of the used fiber, a used number and the like. In this case, the normal direction of the club face 2 is regarded as a line segment projecting a normal line drawn from a head gravity point to the club face 2 to a horizontal surface in the standard condition mentioned above.

Figure 7A:
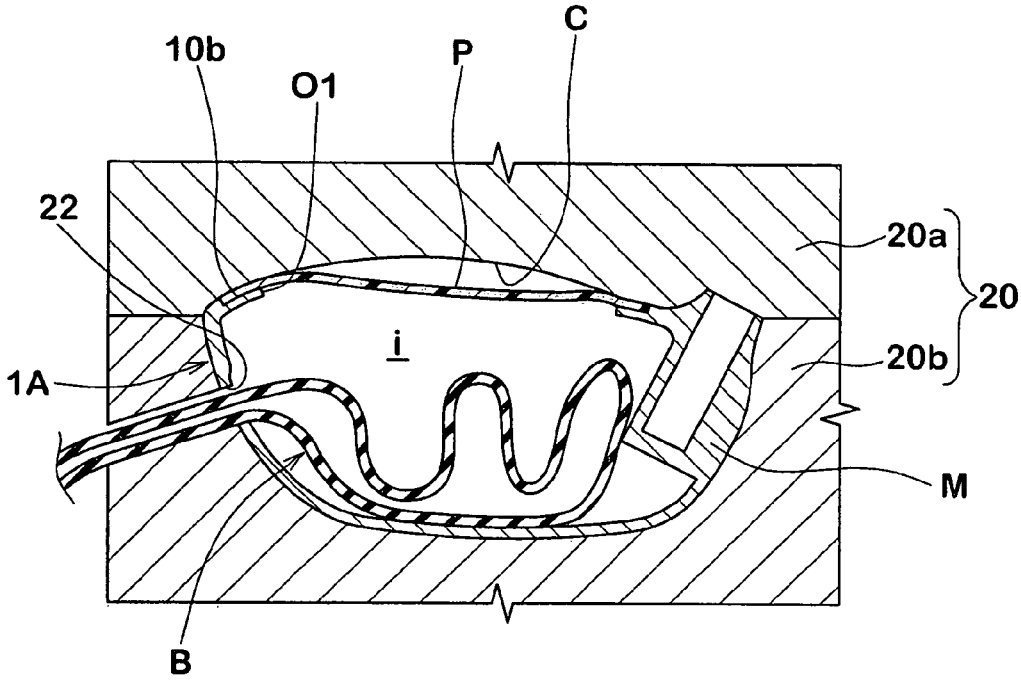
FIGS. 7(A) and 7(B) are cross sectional views showing a method of molding and concurrently integrating the FRP member.
Figure 8:
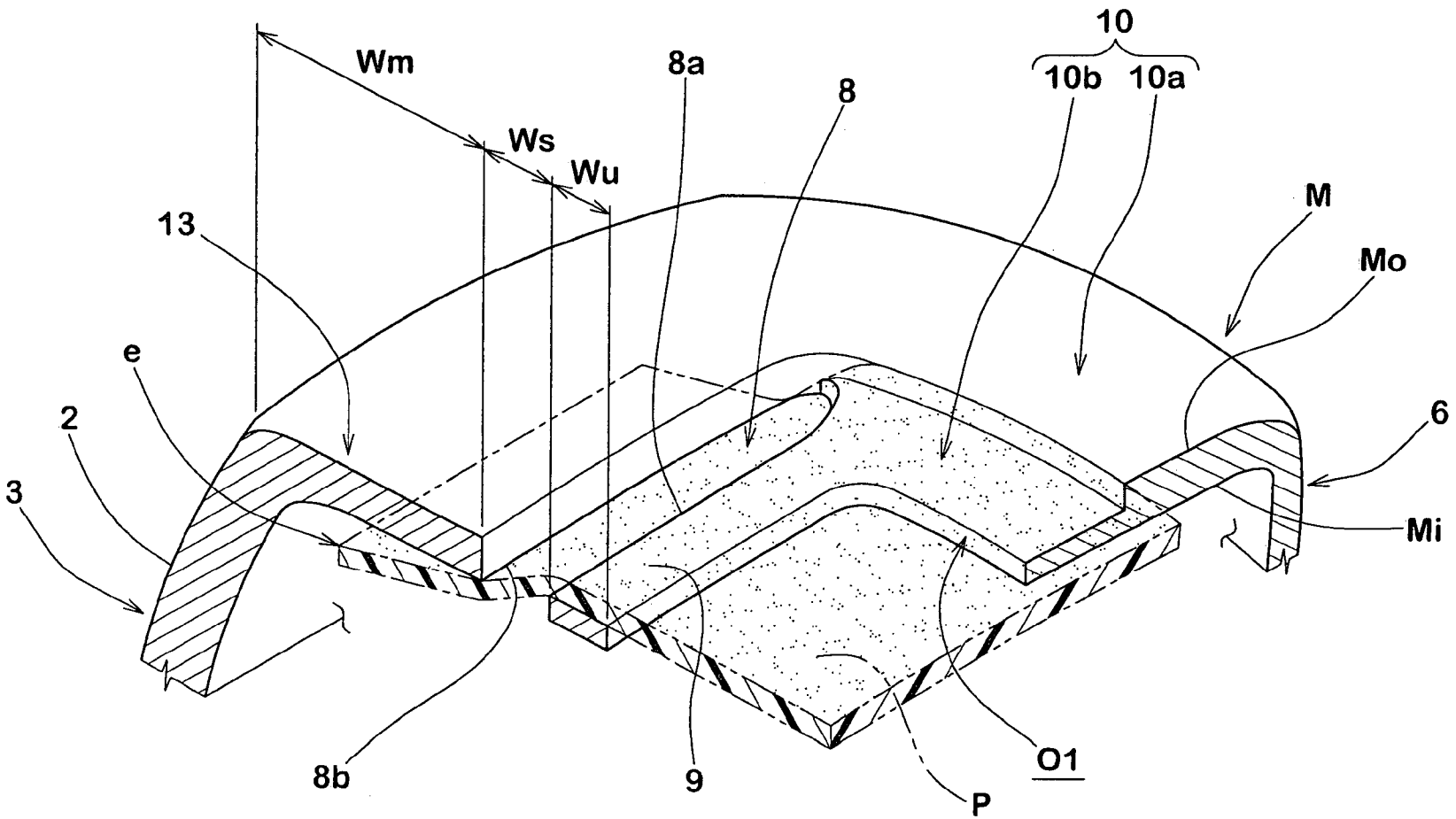
FIG. 8 is a perspective view showing a part of the metal member.
Figure 9A:
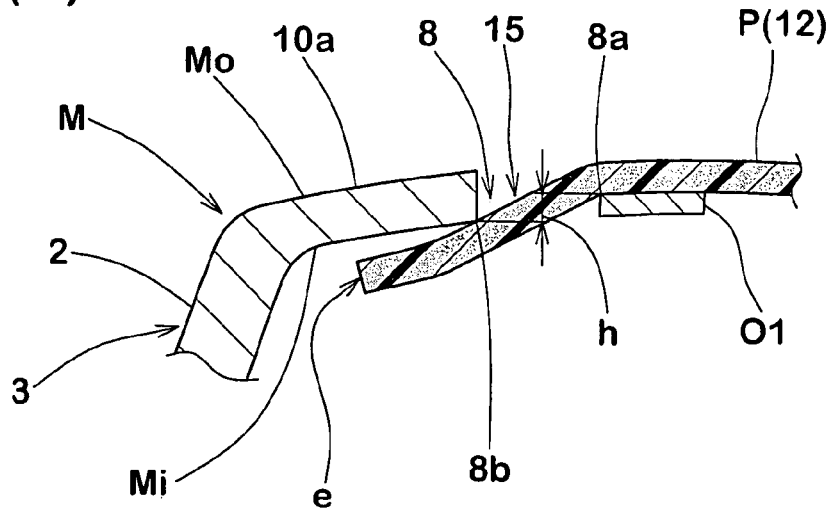
FIGS. 9(A), 9(B) and 9(C) are cross sectional views showing a joint between the metal part and the FRP member.

Next, as shown in FIG. 7(A), there is executed a preliminary assembling step of assembling a head base body 1A by attaching the laminated body P to the opening O1 of the metal member M so as to cover the opening O1. At this time, at least one prepreg ply 11 is formed as a locking prepreg ply 12 in which an end edge e thereof enters into the slit 8 from one side of an outer surface Mo or an inner surface Mi of the metal member M and gets out of the other side so as to extend along the surface thereof, as shown in FIGS. 8 and 9(A). In the present embodiment, the one side corresponds to the outer surface Mo side of the metal member M, and the other side corresponds to the inner surface Mi side of the metal member M. Further, all the prepreg plies 11 constructing the laminated body P constitute the locking prepreg plies 12. In this case, in FIG. 9A, the end edge e of the locking prepreg plies 12 are apart from the inner surface Mi of the metal member M, however, it is desirable to temporarily fasten this portion previously by using an adhesive agent, a primer or the like.

Figure 9B:
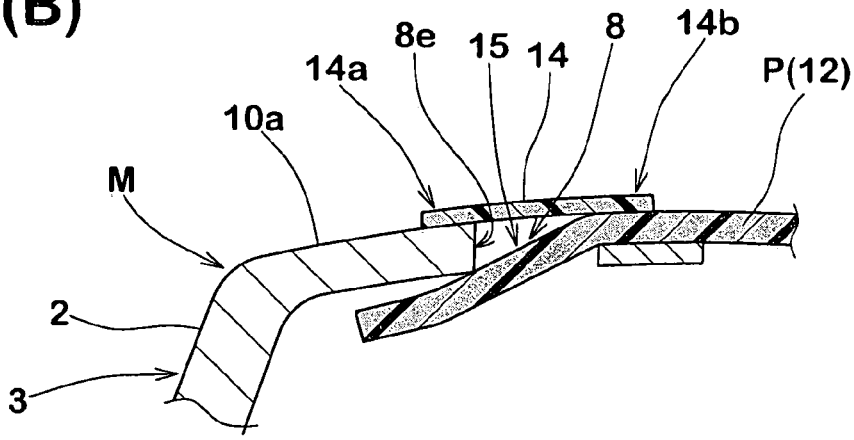

Further, the other peripheral edge portion of the locking prepreg plies 12 is arranged so as to be in contact with the receiving portion 10*b* provided around the opening O1. It is desirable to temporarily fasten the metal member M and the laminated body P by interposing, for example, the thermosetting adhesive agent, the resin primer or the like between the receiving portion 10*b* and the laminated body P, so as to stabilize the state and prevent both the members from being displaced. Accordingly, it is possible to improve a molding accuracy of the head base body 1A. Further, as shown in FIG. 9(B), it is desirable to arrange at least one auxiliary prepreg ply 14 in a step portion 15 having a triangular cross sectional shape and formed by one end surface 8*e* of the slit 8 and an outer surface of the locking prepreg plies 12 passing through the slit 8. The auxiliary prepreg ply 14 according to the present embodiment has a one side edge 14*a* adhered to the metal member M and the other side edge 14*b* adhered to the laminated body P. Therefore, the step portion 15 is covered with auxiliary prepreg ply 14. The auxiliary prepreg 14 mentioned above fills up at least a part of the step portion 15 at a time of executing a curing step, and serves for absorbing the concavity and convexity of the step portion 15.

Further, the preliminarily assembled head base body 1A is set in a metal mold 20, for example, constituted by a pair of detachable upper mold 20*a* and lower mold 20*b*, as shown in FIG. 7(A). Further, an expandable and deflatable bladder B is inserted from a through hole 22 previously provided in the metal member M and communicated with a hollow portion i, on the basis of incomings and outgoings of the pressurized fluid. In the present embodiment, the through hole 22 is provided in the side portion 6, however, the structure is not limited to this position. Further, the preliminary assembling step can be executed in a state in which the metal member M is previously set to the lower mold 20*b*.

Figure 7B:
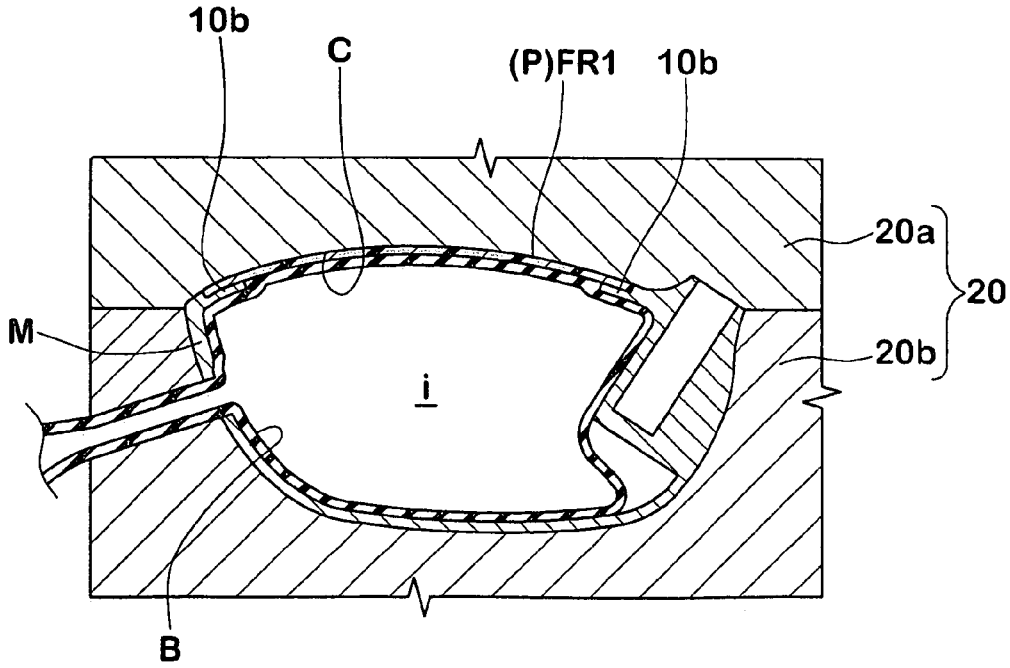
Figure 9C:
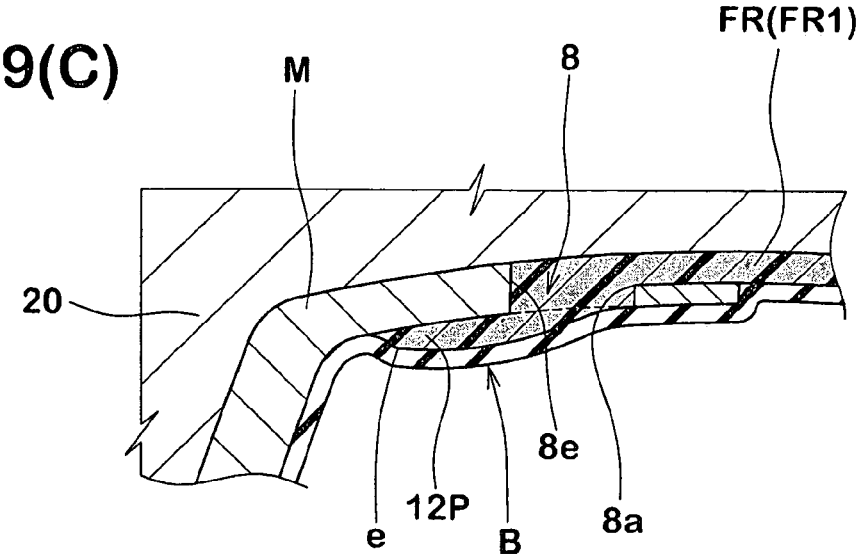

Thereafter, the metal mold 20 is heated, and as shown in each of FIGS. 7(B) and 9(C), there is executed the curing step of expanding and deforming the bladder B in the hollow portion i. Accordingly, the laminated body P of the prepreg plies are exposed to the heat and the pressure from the bladder B so as to be deformed along a cavity C of the upper mold 20*a* and be molded to the desired crown side FRP member FR1, and a peripheral edge portion of the laminated body P is integrally adhered to the receiving portion 10*b*. Further, the end edge e of the locking prepreg plies 12 entering into the hollow portion i from the slit 8 extends in an opposite direction to the opening portion O1 in this example, and is integrally adhered and hardened along an inner surface Mi of the metal member M thereto so as to form a locking portion 12P. When the cure is finished, the bladder B is deflated so as to be taken out to an external portion of the metal member M from the through hole 22. The through hole 22 is closed by a member such as a cover provided with a trade name of the head, an ornamental pattern or the like, for example, in the later step.

The crown side FRP member FR1 formed in this manner includes a locking portion 12P which at least partly enters into the slit 8 of the metal member M so as to be locked in a crank shape. Accordingly, the crown side FRP member FR1 is adhered to the metal member M in a wide area and an adhesive strength is improved. Further, the crown side FRP member FR1 is pinched by the front and rear end surfaces 8*e* and 8*e* of the slit 8, in the portion passing through the slit 8 of the metal member M. Therefore, the metal member M is physically constrained by the slit 8 in a motion in the longitudinal direction of the crown side FRP member FR11. In particular, since a very great stress or strain is applied to the face portion side of the crown portion 4 at a time of striking the ball, a higher bonding strength is required, however, the bonding strength between the metal member M and the FRP member FR1 is improved by forming the slit 8 and the locking portion 12P as in the present embodiment, whereby it is possible to achieve a high durability. In the present embodiment, there is exemplified the structure in which only one slit 8 is provided around the opening O1, however, two or more slits may be provided. For example, the slit 8 may be separately provided in the face surface 2 side and the back face side (not shown).

Figure 10:
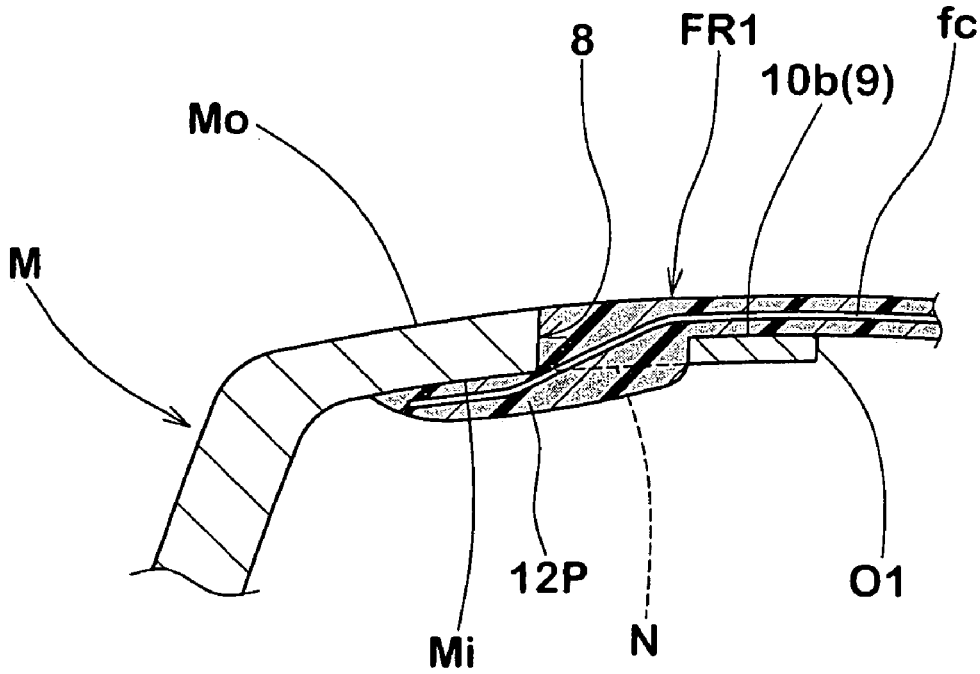
FIG. 10 is a cross sectional view showing a joint between the metal member and the FRP member.
Figure 11A:
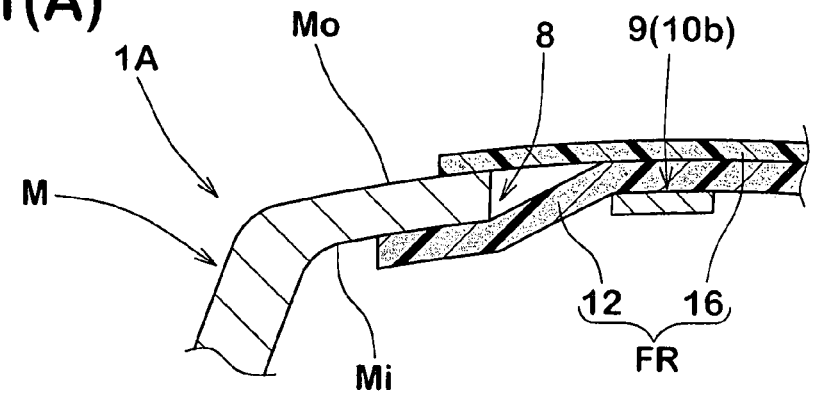
FIGS. 11(A), 11(B), 11(C) and 11(D) are cross sectional views showing another embodiments of the joint between the metal member and the FRP member.
Figure 11B:
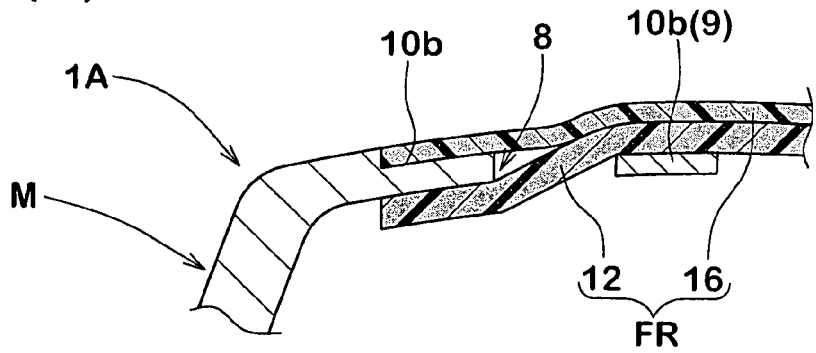
Figure 11C:
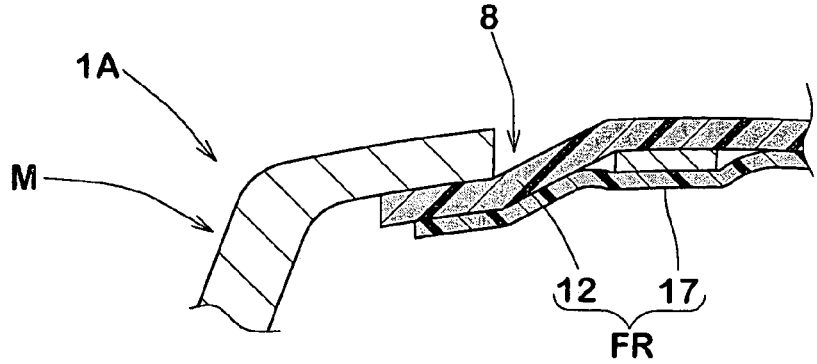
Figure 11D:
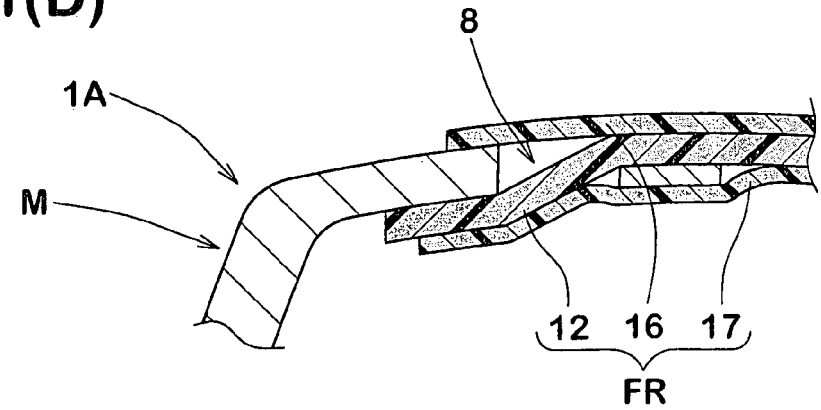

Further, the locking portion 12P is formed by at least one locking prepreg ply 12. Accordingly, the locking portion 12P can include continuous fibers fc which extends along a cross section of the locking prepreg 12 and is folded in a crank shape, as briefly shown in FIG. 10. As a result of being reinforced by the continuous fibers fc mentioned above, in the crown side FRP member FR1, a ply separation is hard to be generated in an interface between the inner surface Mi side and the outer surface Mo side of the metal member M, as shown by a broken line N. Accordingly, the crown side FRP member FR1 according to the present embodiment can achieve a stronger engaging effect with the metal member M. On the other hand, in the conventional structure shown in FIG. 15, the continuous fibers f mentioned above is not included, and the lowering of the bonding strength tends to be generated by the ply separation. As mentioned above, since the locking portion 12P in the head 1 is made of the hardened material of the locking prepreg 12, the durability of the bonding portion is further improved.

Further, the slit 8 contributes to the reduction of the metal material forming the crown portion 4. Accordingly, it is possible to intend to reduce the weight of the head 1 and it is possible to set the head gravity point to be low. Further, the slit 8 provided at the position close to the upper edge 2*a* of the face surface 2 serves for largely deflecting the crown portion 4 at a time of striking the ball on the basis of the elastic deformation, making an apparent loft angle of the face surface 2 large, and improving a repulsion performance on the basis of a spring effect. Therefore, it is possible to improve a carry of the ball.

As shown in FIG. 8, a width Ws of the slit 8 is not particularly limited, however, if it is too small, it is hard to insert the end edge of the locking prepreg plies 12 to the slit 8 so as to generate a tendency of lowering a productivity, and if it is inversely too large, the folding rigidity is lowered so as to generate a tendency that the durability of the metal member M is lowered. From this point of view, it is desirable that the width Ws of the slit 8 is preferably not less than 0.5 mm, more preferably not less than 0.8 mm, and further preferably not less than 1.0 mm. Further, it is desirable that the upper limit is preferably not more 10.0 mm, more preferably not more than 8.0 mm, and further preferably not more than 5.0 mm. In this case, the slit width Ws according to the present embodiment is exemplified by the width which is substantially uniform, however, can be changed as occasion demands.

Further, as shown in FIG. 2, a length Ls in a longitudinal direction of the slit 8 is not particularly limited, however, if the length Ls is too small, there is a tendency that an effect of improving the bonding strength between the FRP member FR and the metal member M can not sufficiently obtained, and if it is inversely too large, the rigidity of the joint portion 9 pinched between the opening portion O1 and the slit 8 is lowered so as to generate a tendency of deteriorating the durability. From this point of view, it is desirable that the length Ls of the slit is preferably not less than 50 mm, more preferably not less than 70 mm, and further preferably not less than 90 mm. Especially, it is desirable that a ratio (Ls/L) between the length Ls of the slit 8 and the opening length L of the opening O1 is preferably not less than 1/10, more preferably not less than 1/8, further preferably not less than 1/5, and particularly preferably not less than 1/4. Further, it is desirable that the upper limit is preferably not more than 1, more preferably not more than 1/2, and further preferably not more than 1/3.

Further, as shown in FIG. 8, in the metal member M, it is desirable that both of a width Wu in the head longitudinal direction of the joint portion 9 (constituting a part of the receiving portion 10*b* in the present example) pinched by the opening O1 and the slit 8, and a width Wm in the head longitudinal direction of a crown front portion 13 between the slit 8 and the upper edge 2*a* of the club face 2 are not less than 1.0 mm, more preferably not less than 5.0 mm, and further preferably not less than 10.0 mm. Further, it is desirable that an upper limit thereof is not more than 30.0 mm, more preferably not more than 25.0 mm, and further preferably not more than 20.0 mm. If each of the widths Wu and Wm is less than 1.0 mm, there is a tendency that the rigidity around the opening O1 is excessively lowered and the adhesive strength is lowered, and if it is inversely more than 30 mm, there is a tendency that the weight saving effect of the crown portion 4 can not be sufficiently obtained such as the opening O1 becoming small.

Further, it is desirable that a ratio (Wm/Wu) of the widths is not less than 0.5, more preferably not less than 0.7, and further preferably not less than 0.8. Further, it is desirable that an upper limit thereof is preferably not more than 10, more preferably not more than 8, and further preferably not more than 6. If the ratio (Wm/Wu) becomes less than 0.5, the width Wm of the crown front portion 13 close to the face portion 3 becomes relatively smaller than the width Wu of the joint portion 9, and there is a tendency that the adhesive area of the portion becomes small, and a lack of strength tends to be generated, and if the ratio (Wm/Wu) mentioned above becomes inversely more than 10, the repulsion performance tends to be deteriorated.

Further, as shown in FIG. 9(A), the slit 8 has a first edge portion 8*a* which extends in the opening O1 side and is positioned in the one side (the outer surface Mo side in this example) of the metal member M, and a second edge portion 8*b* which extends in a far side from the opening O1 and is positioned in the other side (the inner surface Mi side in this example) of the metal member M. It is desirable that a difference h of height between the first edge portion 8*a* and the second edge portion 8*b* is preferably not less than 0.1 mm, more preferably not less than 0.3 mm, and further preferably not less than 0.5 mm. Further, it is desirable that an upper limit thereof is not more than 2.0 mm, more preferably not more than 1.8 mm, and further preferably not more than 1.5 mm. In the case that the difference h of height is less than 0.1 mm, the engaging effect between the locking prepreg plies 12 and the slit 8 is lowered, and the improvement of the bonding strength can not be sufficiently expected by extension, and in the case that it is inversely larger than 2.0 mm, the folding amount at a time when the locking prepreg plies 12 passes through the slit 8 becomes large, and there is a tendency that the durability is lowered such as an excessive folding generated in the fiber.

The head 1 according to the present embodiment can save the weight by using the FRP member FR1. Accordingly, it is possible to form the head at a volume preferably equal to or more than 150 $cm^3$, more preferably equal to or more than 200 $cm^3$, and further preferably equal to or more than 250 $cm^3$. Therefore, it is possible to increase a comfort level when ready to hit the ball, and it is possible to increase a sweet spot area and a moment of inertia. In this case, an upper limit of the head volume is not particularly limited, however, it is desirable that it is, for example, equal to or less than 500 $cm^3$, and on the basis of a rule regulation of R&A and USGA, it is preferable to restrict to be equal to or less than 470 $cm^3$. Further, although not particularly limited, in the standard condition mentioned above, it is desirable that the moment of inertia around a perpendicular passing through the head gravity point is preferably equal to or more than 3000 $g \cdot cm^2$, and more preferably equal to or more than 3500 $g \cdot cm^2$. Further, in the standard condition mentioned above, it is desirable that the moment of inertia around a horizontal axis in the toe and heel direction passing through the head gravity point is equal to or more than 1500 $g \cdot cm^2$, and more preferably equal to or more than 2000 $g \cdot cm^2$.

In FIG. 11, there is shown a preliminarily molded head base body 1A as the other embodiment according to the present invention. In an aspect shown in FIG. 11(A), the FRP member FR comprises at least one locking prepreg ply 12 which enter into the slit 8 from the outer surface Mo of the metal member M and extend along the inner surface Mi, and at least one outer prepreg ply 16 which covers the opening O1, is arranged in an outer side of the locking prepreg ply 12 and extends so as to close the slit 8 without entering into the slit 8. Further, FIG. 11(B) shows an aspect in which the receiving portion 10*b* is provided in both sides of the slit 8. Further, according to an aspect shown in FIG. 11(C), there is exemplified a structure in which the FRP member FR includes at least one locking prepreg ply 12, and at least one inner prepreg ply 17 which covers the opening O1, is arranged in an inner surface of the locking prepreg ply 12 and extends over the slit 8 without entering into the slit 8. Further, FIG. 11(D) exemplifies a structure which includes the locking prepreg ply 12, and the inner and outer prepreg ply 17 and 16.

Figure 12A:
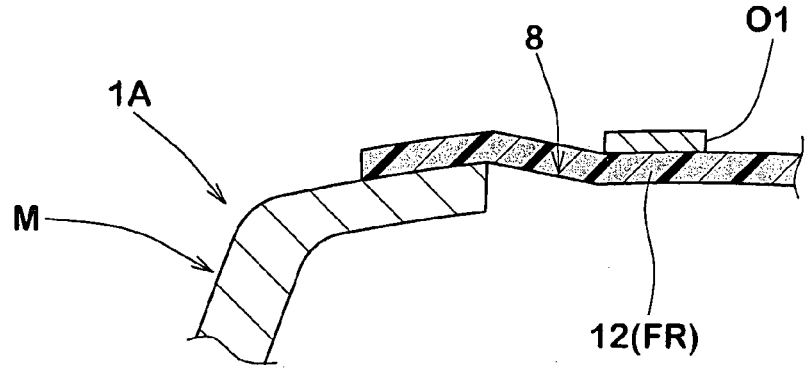
FIGS. 12(A), 12(B) and 12(C) are cross sectional views showing another embodiment of the joint between the metal member and the FRP member.
Figure 12B:
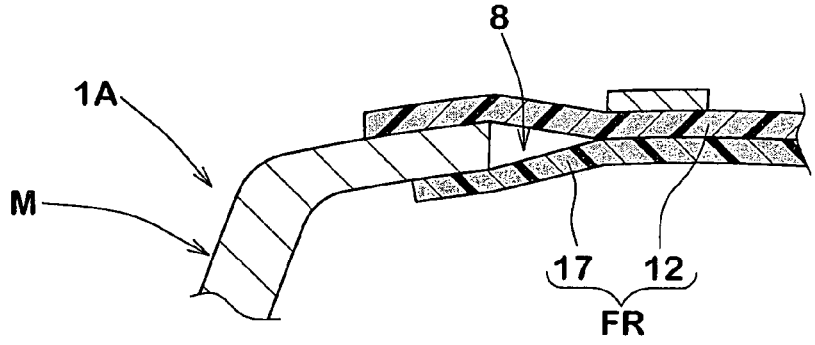
Figure 12C:
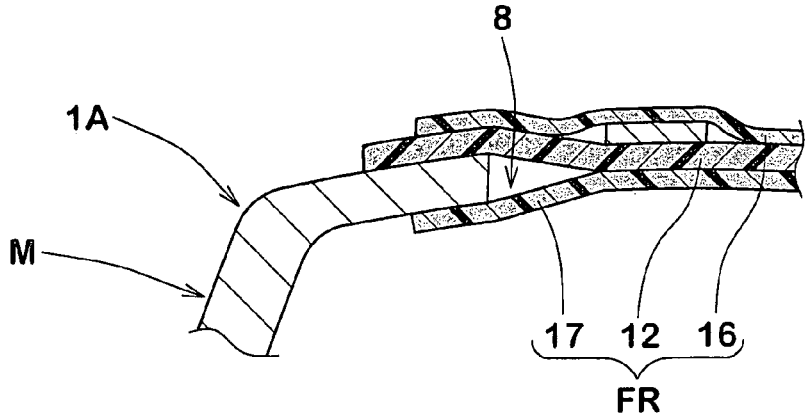

Further, as shown in FIG. 12(A), the FRP member FR may be structured by using at least one locking prepreg ply 12 which enter into the slit 8 form the head inner surface and extend along the head outer surface. Further, as shown in FIG. 12(B), the FRP member comprises at least one locking prepreg ply 12, and the inner prepreg 17 which is arranged in an inner side of the locking prepreg ply 12, and extends so as to close the slit 8 without entering into the slit 8, and further as shown in FIG. 12(C), the FRP member comprises the locking prepreg ply 12, the inner prepreg 17 and at least one outer prepreg ply 16 which is arranged in an outer surface of the locking prepreg ply 12, and extends over the slit 8 without entering into the slit 8.

In this case, the aspects shown in FIGS. 9 and 12(A) particularly serve for saving the weight. Further, according to the aspects shown in FIGS. 9 and 11(B), since FRP member FR does not exist on the surface of the crown portion 4 on the club face 2 side, the structure is preferable in a point that the FRP member FR is more hard to be peeled due to the impact at a time of striking the ball. Further, according to the aspects shown in FIGS. 11(D) and 12(C), the bonding area between the metal member M and the FRP member FR is increased and the adhesive strength can be further improved.

Figure 13A:
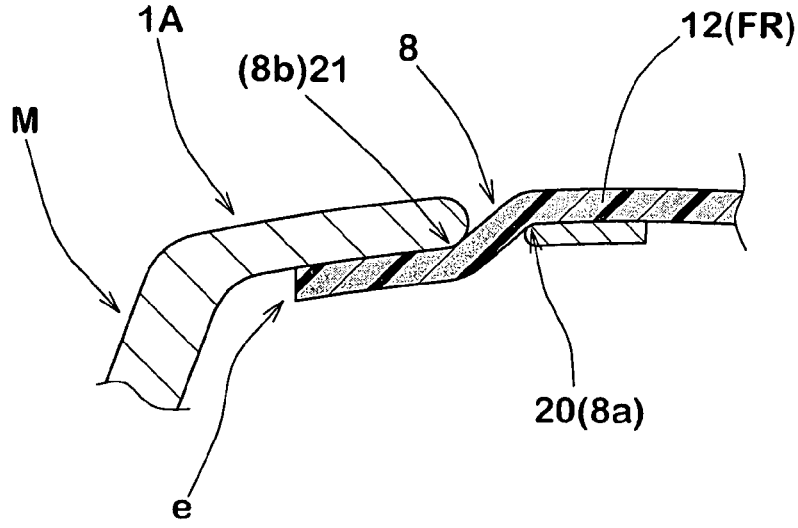
FIGS. 13(A) and 13(B) are cross sectional views showing another embodiments of the joint between the metal member and the FRP member.
Figure 13B:
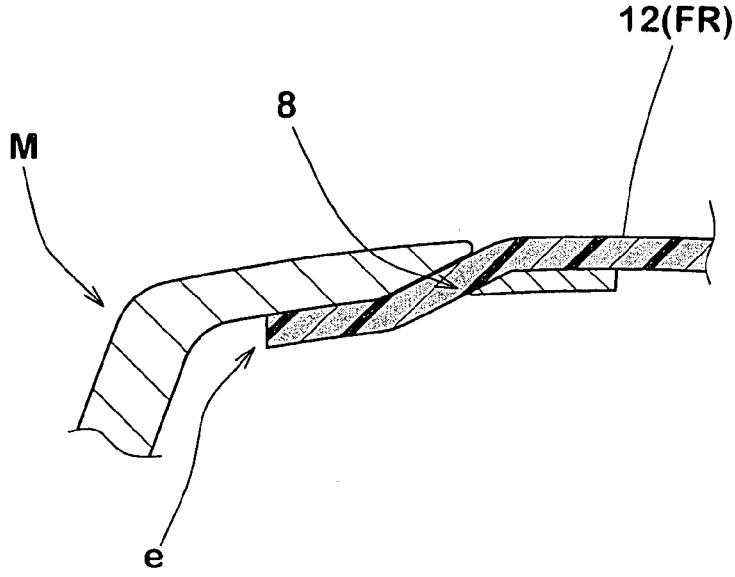

Further, FIG. 13 shows the other embodiment according to the present invention. In an embodiment shown in FIG. 13(A), the slit 8 is exemplified by a structure in which at least corner portions 20 and 21 (the first and second edge portions 8*a* and 8*b*) being in contact with the locking prepreg 12 are rounded in a chamfer manner, in a cross section perpendicular to the longitudinal direction of the slit 8. The slit 8 mentioned above serves for preventing a damage of the fiber in the auxiliary assembling at a time of passing the locking prepreg ply 12 through the slit 8 so as to fold and at a time of the inner pressure molding and improving the durability. A radius of curvature of the rounded corner portions 20 and 21 is not particularly limited, however, is desirably set to be, for example, equal to or more than 0.1 mm and equal to or less than 1.0 mm. In the present embodiment, there is shown an aspect in which a chamfer is applied to all the corner portions constituting the slit 8 in addition to the corner portions 20 and 21. Further, FIG. 13(B) exemplifies a structure in which the slit 8 obliquely extends in a depth direction, in a cross section perpendicular to the longitudinal direction of the slit 8. In this example, since the end edge e of the locking prepreg 12 is easily inserted, a molding property is improved.

Figure 14:
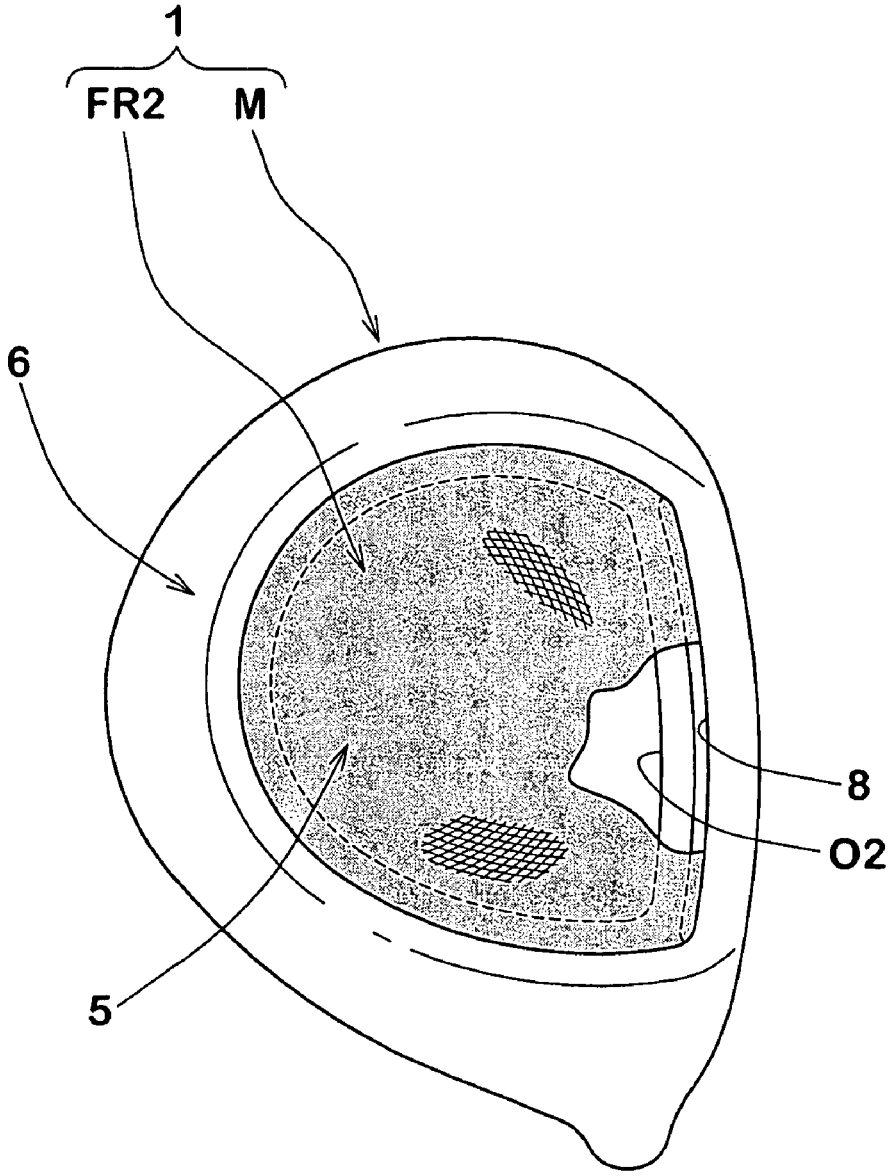
FIG. 14 is a bottom view showing another embodiment of the head.

Further, the head 1 can be structured, as shown in FIG. 14, such that an opening O2 is provided in the sole portion 5 in place of the crown side FRP member FR1 or together with the crown side FRP member FR1, and a sole side FRP member FR2 is provided there. In the latter embodiment, it is possible to further increase a moment of inertia around a vertical axis of the head.

The present invention suitably applied to metal wood-type hollow heads, but it is also possible to apply the invention to other types of club heads such as utility-type, iron-type, and patter-type.

Further, in the embodiment mentioned above, there is shown the aspect in which the FRP member made of the fiber reinforcing resin is constituted by the crown side FRP member FR1, however, a part of the opening O1 of the metal member M may be provided astride each of the crown portion 4 and the side portion 6 on the back face side. Further, the FRP member may be arranged in the slit 8 and the opening O1 so as to be adhered after being previously molded in a predetermined shape by a metal mold, in addition to the internal pressure molding method.

Comparison Tests

Wood-type golf club heads having the same outer shapes shown in FIG. 1 and a head volume of 400 $cm^3$ and specifications shown in Table 1 were made and tested for the durability, the ease of swinging and the flight characteristic of a hit ball.

In each of the cases, the metal member is cast on the basis of Ti-6Al-4V, and a shape of the opening is formed by applying a predetermined machine process to the opening. Further, the head is produced via the auxiliary assembling step and the curing step.

In Examples 1 to 3 and Comparative Examples 1 to 3, the ratio (S1/S) is set to 0.6. Further, the FRP member uses the fiber reinforced resin obtained by reinforcing the epoxy resin by the carbon fiber in the allocating direction in FIG. 6 (the used prepreg ply is TR350L-150S manufactured by Mitsubishi Rayon Co., Ltd.).

and at a position 10 mm apart from the face center to the crown side, whereby the ball striking number until any damage such as a crack or a fracture is generated is recorded. In this case, with regard to the durability, two heads having the same structure are prepared, and a better result valve is employed.

Ease of Swing

Ten golfers having handicaps of 0 to 15 actually strikes the golf ball with each of the golf clubs, and evaluates an ease of swing on the basis of their own feelings according to a five-point method, whereby an average point is indicated. The larger the numeral value is, the better the golf club is.

Striking Angle, Amount of Backspin and Carry

Ten golfers having handicaps of 0 to 15 actually strikes five golf balls with each of the golf clubs, and each of a striking angle of the ball, an amount of backspin and a carry is measured.

TABLE 1

Figure 15A:
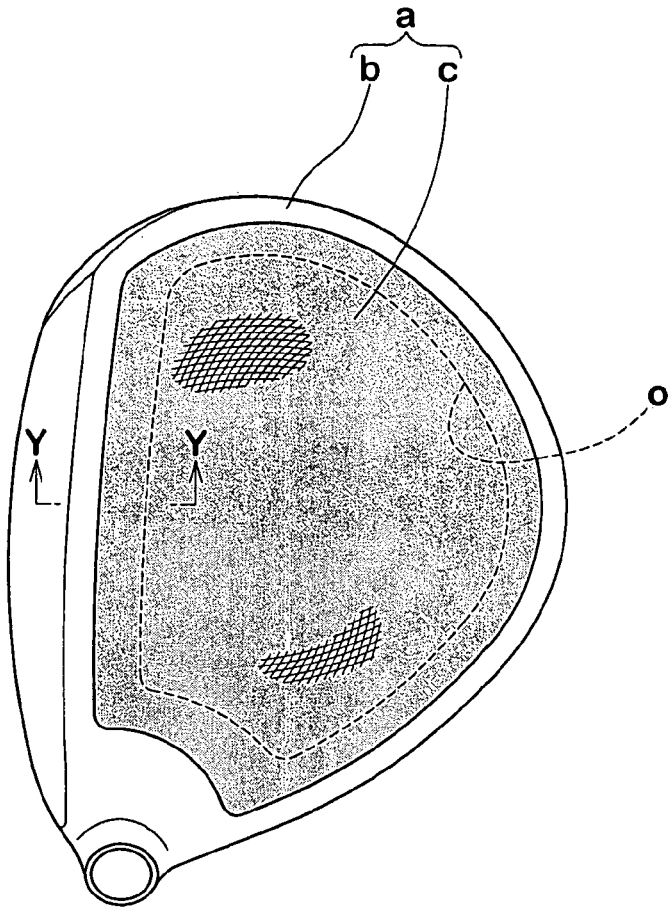
FIG. 15(A) is a plan view showing a conventional head.
Figure 15B:
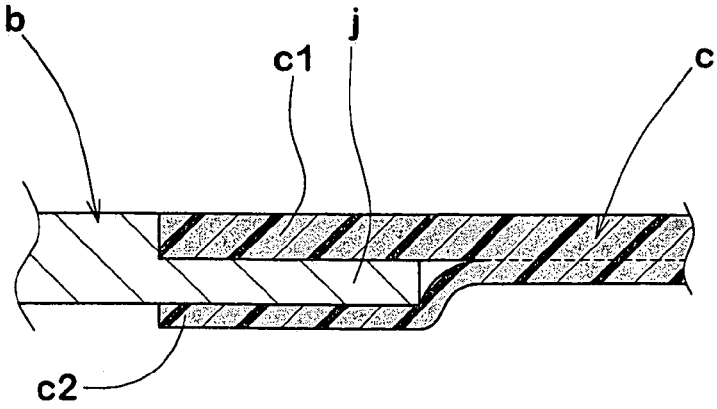
FIG. 15(B) is a cross sectional view taken on line Y-Y in FIG. 15(A).
Figure 16A:
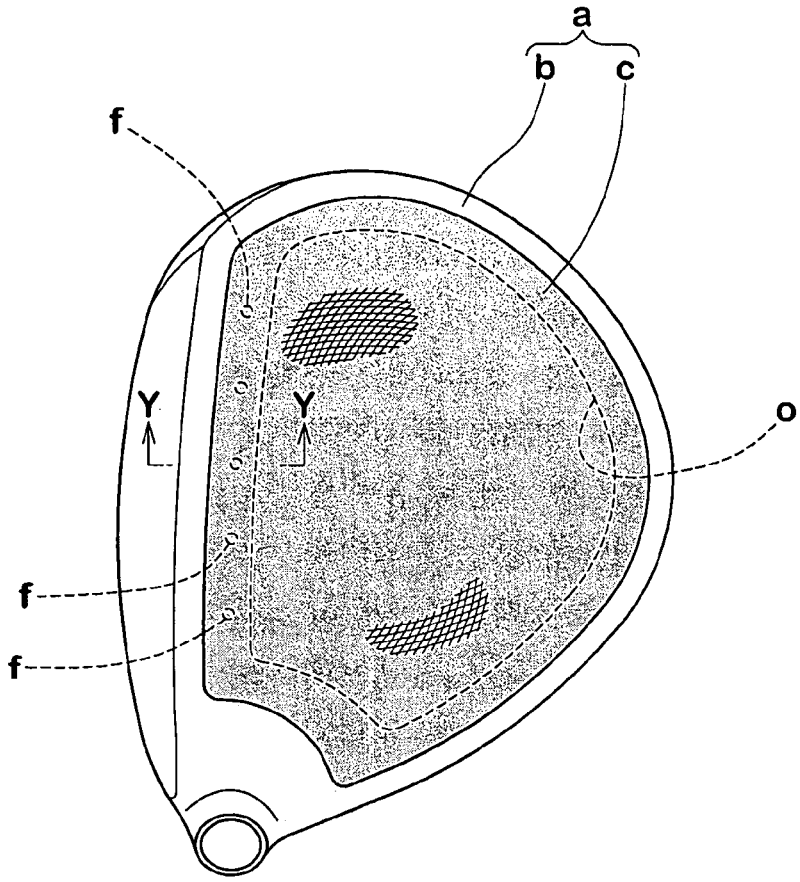
FIG. 16(A) is a plan view showing another conventional head.
Figure 16B:
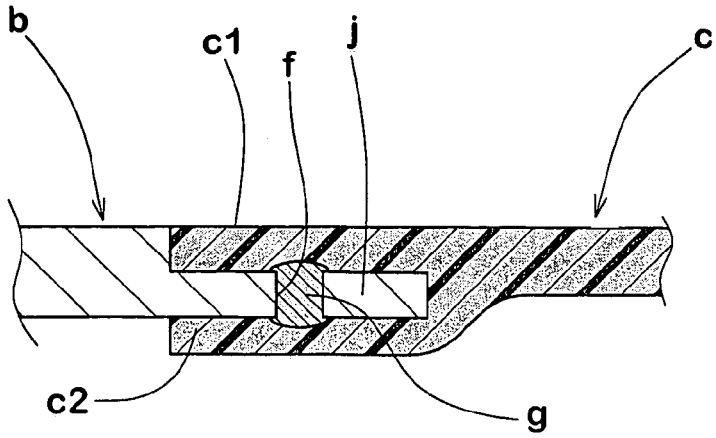
FIG. 16(B) is a cross sectional view taken on line Y-Y in FIG. 16(A).
Figure 17A:
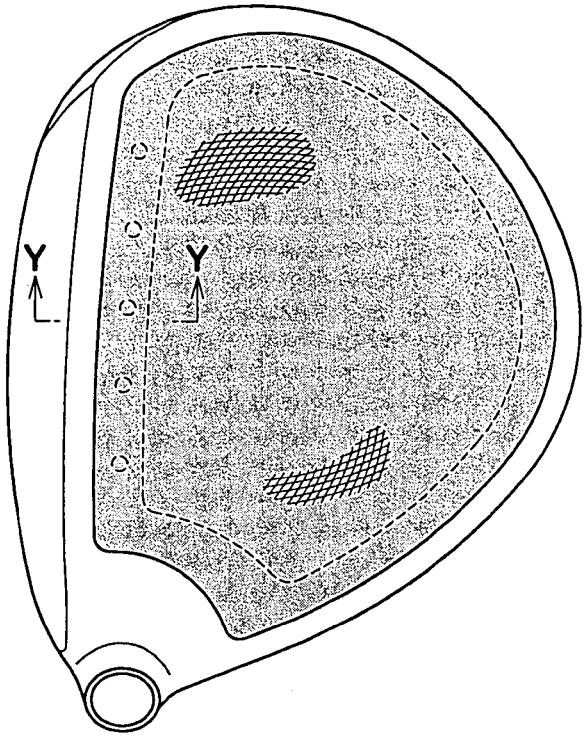
FIG. 17(A) is a plan view showing another conventional head.
Figure 17B:
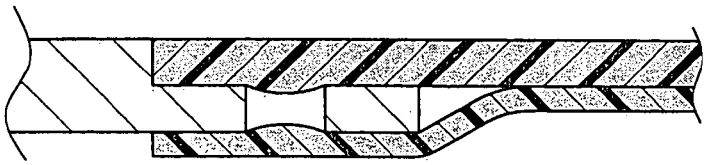
FIG. 17(B) is a cross sectional view taken on line Y-Y in FIG. 17(A).
Figure 18A:
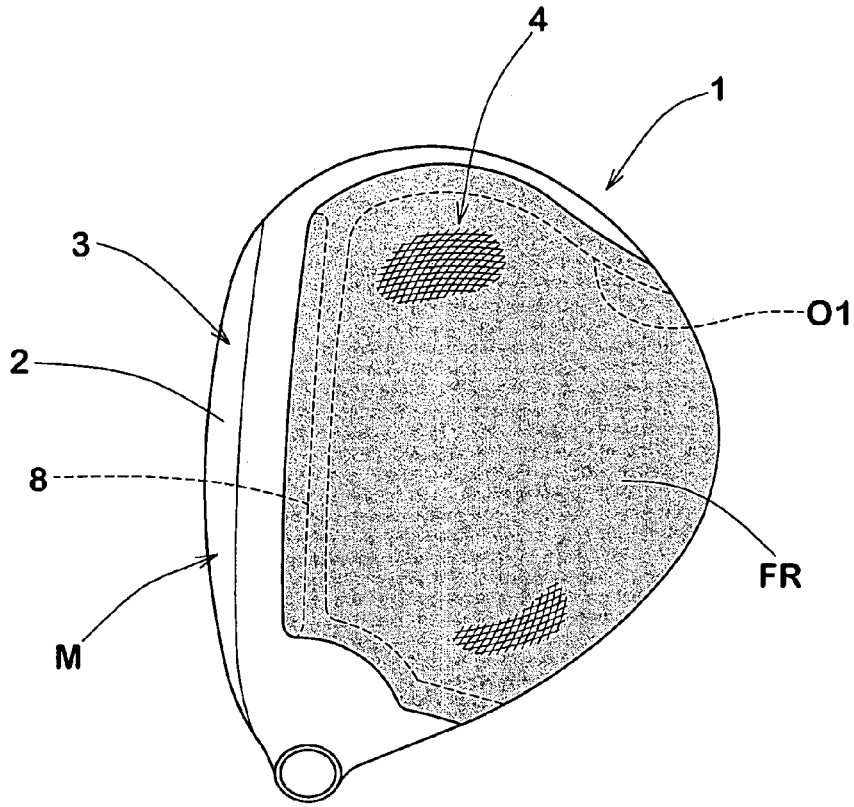
FIG. 18(A) is a plan view showing another embodiment of the head.
Figure 18B:
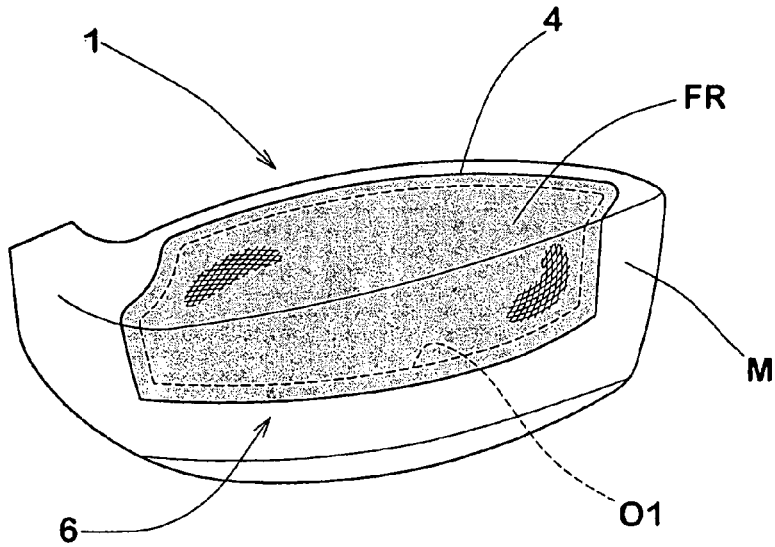
FIG. 18(B) is a back view thereof.

| | | Example 1 | Example 2 | Example 3 | Example 4 | Comparative Example 1 | Comparative Example 2 | Comparative Example 3 |
|---|---|---|---|---|---|---|---|---|
| Structural drawing | | FIG. 1 | FIG. 1 | FIG. 1 | FIG. 18 | FIG. 15 | FIG. 17 | FIG. 16 |
| Position of FRP member | | Crown portion | Crown portion | Crown portion | Crown portion and sole portion | Crown portion | Crown portion | Crown portion |
| Head weight [g] | | 200 | 199 | 200 | 190 | 210 | 205 | 210 |
| Length of slit LS/L | | 1/4 | 1/3 | 1/4 | 1/3 | — | — | — |
| Width of slit Ws [mm] | | 1.0 | 2.0 | 0.05 | 1.0 | — | — | — |
| Width of joint portion Wu [mm] | | 5.0 | 5.0 | 0.5 | 5.0 | — | — | — |
| Width of crown front portion Wm [mm] | | 20.0 | 19.0 | 10.0 | 20.0 | — | — | — |
| Ratio (Wm/Wu) | | 4.0 | 3.8 | 4.0 | 40.0 | — | — | — |
| Test result | Durability | 11000 | 11500 | 9000 | 10400 | 7500 | 8000 | 8500 |
| | Ease of swing | 4 | 4 | 4 | 5 | 3 | 3 | 3 |
| | Striking angle [deg] | 19 | 20 | 19 | 20 | 15 | 14 | 14 |
| | Amount of backspin [rpm] | 2000 | 1950 | 2000 | 2100 | 3200 | 3100 | 2900 |
| | Carry [yard] | 155 | 158 | 155 | 157 | 140 | 143 | 139 |

Further, Example 1 is formed in the shape shown in FIGS. 1 to 5, and Example 2 is provided with a large FRP member astride the side portion as shown in FIG. 18.

Further, Comparative Example 1 is formed by omitting the slit from Example 1, and Comparative Example 2 is formed by arranging five circular through holes between the opening portion and the upper edge of the face surface so as to improve the engaging force with the FRP member as shown in FIG. 17.

Further, Comparative Example 3 is formed by arranging a cord-like body made of the fiber reinforced resin in the through hole so as to integrally form the upper and lower FRP members, as shown in FIG. 16.

The test method is as follows.

Durability Test

A 45 inch wood type club is manufactured by way of trial by attaching each of the heads to a carbon shaft MP-200 manufactured by SRI Sports Limited, this is attached to a swing robot (SHOT ROB IV) manufactured by MIYAMAE Co., Ltd., and a golf ball is struck at a head speed of 40 m/s As a result of the tests, it can be confirmed that the heads according to the examples improve the durability in comparison with the comparative examples. Further, in the example, it can be considered that since the slit is provided along the upper edge of the face surface, the rigidity of the crown front portion is lowered, and the amount of deformation of this portion is increased at a time of striking a ball, whereby the striking angle is enlarged. As a result, it can be considered that the amount of backspin is reduced and the carry is increased. Therefore, according to the golf club head of the present example, it is possible to increase the carry of the ball while improving the durability.

What is claimed is:

1. A hollow golf club head comprising a metal member made of at least one kind of metal material having at least one opening, and a FRP member made of a fiber reinforced resin attached to the metal member so as to cover the opening, wherein the metal member has at least one slit extending along the opening, in at least a part of a periphery of the opening, and the FRP member has a locking portion entering into the slit from one side of an outer surface or an inner surface of the metal member and getting out of the other side so as to extend along a surface thereof.

2. The golf club head according to claim 1, wherein the FRP member is made of a plurality of prepreg plies comprising at least one locking prepreg ply having reinforcing fibers which extend continuously from the one side to the other side of the metal member.

3. The golf club head according to claim 1, wherein the metal member comprises a face portion whose front face defines a club face for striking a ball and a crown portion intersecting the club face at the upper edge thereof, the opening is provided with the crown portion, and the slit is provided between the opening and the upper edge of the club face.

4. The golf club head according to claim 3, wherein in the metal member, a width Wu between the opening and the slit is from 1 to 30 mm, a width Wm between the slit and the upper edge of the club face is from 1 to 30 mm, and a ratio (Wm/Wu) of the widths is from 0.5 to 10.

5. The golf club head according to claim 1, 2 or 3, wherein the slit has a first edge extending along a side of the opening and positioned at the one side of the metal member, and a second edge extending along a far side from the opening and positioned at the other side of the metal member, and a difference of the height between the first edge and the second edge is from 0.1 to 2.0 mm.

6. The golf club head according to claim 1, 2 or 3, wherein the slit has at least a corner portion which is in contact with the locking portion, and the corner portion is rounded in a cross section perpendicular to a longitudinal direction of the slit.

7. The golf club head according to claim 2, wherein the locking prepreg ply comprises at least one prepreg ply entering into the slit from the outer surface of the metal member and extending along the inner surface thereof.

8. The golf club head according to claim 7, wherein the prepreg plies comprise at least one outer prepreg ply arranged in an outer side of the locking prepreg ply, and extending so as to cover the opening and the slit without entering into the slit.

9. The golf club head according to claim 2, wherein the locking prepreg ply comprises at least one prepreg ply entering into the slit from the inner surface of the metal member and extending along the outer surface thereof.

10. The golf club head according to claim 9, wherein the prepreg plies comprise at least one inner prepreg ply arranged in an inner side of the locking prepreg ply, and extending so as to cover the opening and the slit without entering into the slit.

11. The golf club head according to claim 1, wherein the slit has a width in a range of from 0.5 to 10.0 mm.

* * * * *